US005856755A

United States Patent [19]

Falconer et al.

[11] Patent Number: 5,856,755

[45] **Date of Patent: *Jan. 5, 1999**

[54] BUS TERMINATION VOLTAGE SUPPLY

[75] Inventors: Maynard Falconer; Songmin Kim, both of Hillsboro, Oreg.

[73] Assignee: Intel Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 652,162

[22] Filed: May 23, 1996

[51] Int. Cl.[6] ..... G05F 1/10

[52] U.S. Cl. ..... 327/540; 327/538; 323/315

[58] Field of Search ..... 327/538, 540, 327/541, 543; 323/312, 313, 315

[56] References Cited

U.S. PATENT DOCUMENTS

| | | | |
|---|---|---|---|
| 3,577,167 | 5/1971 | Avins | 327/540 |
| 4,204,133 | 5/1980 | Ahmed | 323/315 |
| 4,323,794 | 4/1982 | Hoehn | 327/538 |
| 4,458,201 | 7/1984 | Koen | 323/317 |
| 4,481,463 | 11/1984 | Ferrieu | 323/315 |
| 4,691,262 | 9/1987 | Chalfin | 323/315 |
| 5,015,942 | 5/1991 | Kolanko | 323/315 |
| 5,451,859 | 9/1995 | Ryat | 323/315 |
| 5,498,952 | 3/1996 | Ryat | 323/315 |

*Primary Examiner*—Terry D. Cunningham
*Attorney, Agent, or Firm*—Jeffrey S. Draeger

[57] ABSTRACT

A bus termination voltage supply. The invented voltage supply provides an output voltage from an input voltage using biasing and isolation circuits. A voltage isolation circuit couples an input voltage node to an output node to provide the output voltage. The isolation circuit includes a transistor driver element which is coupled to the input voltage node and the output node. The voltage supply also includes a biasing circuit having a voltage divider and a bias transistor. The voltage divider has a first voltage divider element coupling the output node to a voltage divider node. The voltage divider has a second voltage divider element coupling the voltage divider node to a second voltage supply node. The bias transistor couples a control input of the transistor driver element to the second voltage supply node under the control of a bias transistor control input coupled to the voltage divider node. The voltage supply may further include a feedback circuit comprising bias resistor which couples the input voltage supply to the driver control input. This voltage supply may be used to provide a termination voltage for a signal line in a computer system.

21 Claims, 2 Drawing Sheets

BUS TERMINATION VOLTAGE SUPPLY

FIELD OF THE INVENTION

The present invention pertains to the field of computer systems. More specifically, the present invention relates to providing a termination voltage to a computer system bus.

BACKGROUND

Continuing growth of computing power is fueled by a combination of architectural refinements and increased computer system operating frequency. While individual computer components benefit from increasing parallelism and decreasing clock periods, these individual components are ultimately limited by the buses which connect them. Accordingly, an increase in the operating frequency of a computer system bus can provide a great boon to total computer system performance.

Techniques which facilitate increasing bus frequencies are consequently likely to gain widespread acceptance. One such technique is the use of terminating resistors which couple the ends of bus signal lines to a terminating voltage. Such termination advantageously reduces signal line noise by eliminating signal distorting discontinuities formed by unterminated signal line ends.

While termination reduces signal line noise, terminating resistors cause additional power to be dissipated when the signal line is driven by a bus agent to a voltage other than the terminating voltage. The amount of power dissipated in the terminating resistors may be reduced by limiting the total voltage swing of the computer system bus. This not only limits the maximum voltage dissipated across a terminating resistor, but also allows more rapid signal switching.

Considering these advantages, a computer system utilizing terminating resistors often terminates the bus to a voltage less than the computer system voltage. In most cases, this terminating voltage is derived from the computer system voltage supply which typically fluctuates during normal operation. Due to the smaller voltage swing of the signal lines, fluctuations of the magnitude found in the computer system voltage supply may disrupt signaling if directly reflected in the terminating voltage.

A series of diodes which reduces the computer system voltage to the terminating voltage is one prior art terminating voltage supply which directly reflects such fluctuations. Forward biased diodes provide a voltage drop of the threshold voltage of the diode, thus an appropriate voltage drop from the computer system voltage to the terminating voltage may be obtained by the series coupling of several such diodes. Unfortunately, the fixed diode threshold voltage causes the termination voltage to directly reflect changes in the computer system voltage.

This may be problematic, for example, where a 3.3 volt supply allows 10% fluctuation and the terminating voltage is 1.5 volts. In this case, the permissible 0.3 volt fluctuation in the computer system voltage produces an intolerable 20% variation in the termination voltage. While a diode based solution may be cost effective, the resulting termination voltage variation may not be acceptable.

A commercially available voltage regulator chip is one prior art solution which can deliver a relatively stable voltage supply. These chips supply up to a certain amount of current within a given voltage range. While these chips typically overcome the problem of excessive voltage variation, voltage regulators capable of providing the large current demanded for termination in a high speed computer system may become prohibitively expensive for use in high volume.

Thus, the prior art demonstrates low cost voltage supplies with little power supply noise rejection as well as high cost power supplies delivering a precise output voltage. The prior art does not, however, provide a sufficiently inexpensive terminating voltage supply with adequate power supply noise rejection capabilities.

SUMMARY

The invented voltage supply provides an output voltage from an input voltage using biasing and isolation circuits. A voltage isolation circuit couples an input voltage node to an output node to provide the output voltage. The isolation circuit includes a transistor driver element which is coupled to the input voltage node and the output node. The voltage supply also includes a biasing circuit having a voltage divider and a bias transistor. The voltage divider has a first voltage divider element coupling the output node to a voltage divider node. The voltage divider has a second voltage divider element coupling the voltage divider node to a second voltage supply node. The bias transistor couples a control input of the transistor driver element to the second voltage supply node under the control of a control input coupled to the voltage divider node.

BRIEF DESCRIPTION OF THE FIGURES

The present invention is illustrated by way of example and not limitation in the figures of the accompanying drawings.

DETAILED DESCRIPTION

The present invention provides a bus termination voltage supply. The following description of numerous specific details such as transistor types, resistor values, and current requirements are set forth in order to provide a more thorough understanding of the present invention. It will be appreciated, however, by one skilled in the art that the present invention may be practiced without such specific details. In other instances, control structures and gate level circuits have not been shown in detail in order not to obscure unnecessarily the present invention. Those of ordinary skill in the art, with the described functions, will be able to implement the necessary logic circuits without undue experimentation.

The invented termination voltage supply uses a computer system voltage (Vcc) to generate a termination voltage which rejects noise by way of isolation from the computer system voltage. This voltage supply employs feedback to compensate for changing current loads and provides an inexpensive solution by using a minimal number of components. In one embodiment, additional cost savings arise from the use of discrete components readily available in the market.

Figure 1:
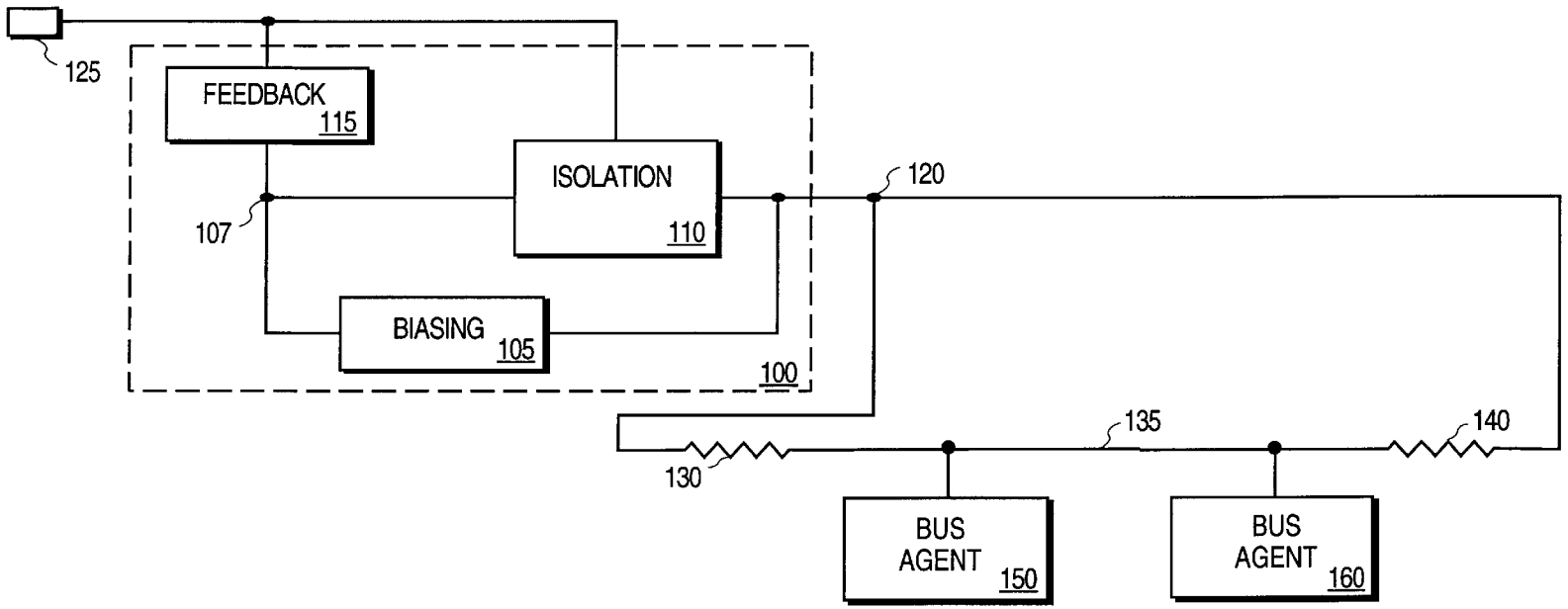
FIG. 1 is a schematic representation of a bus termination voltage supply of the present invention as used in a computer system.

FIG. 1 shows a computer system using the invented voltage supply. This computer system is representative of any computer system utilizing more than one bus agent and communicating via at least one signal line. Any such computer system which relies on a termination mechanism requiring a voltage supply less than the computer system voltage supply may use the voltage supply of the present invention.

As shown, a first bus agent 150 and a second bus agent 160 are coupled to a signal line 135. The signal line is terminated at a first end using a first resistive termination 130 and at a second end using a second resistive termination 140. The signal line is used to convey high and low signal levels between the bus agents. These signal levels are typically represented by high and low voltage levels on the signal line. The resistive terminations couple both ends of the signal line to an output node 120 of the termination voltage supply 100.

In FIG. 1, only one signal line is shown for clarity; however, a typical computer system utilizes a plurality of signal lines to interconnect between various bus agents. All of these signal lines may be terminated in the same fashion as the signal line 135. Additionally, the use of only two bus agents is purely illustrative since many computer systems may employ the invented termination voltage supply and have three or more bus agents.

Regardless of the number of bus agents, the termination voltage supply 100 couples an appropriate termination voltage to the resistive terminations. In one embodiment, the computer system voltage and the termination voltage are potentials greater than a ground voltage. In this embodiment, the termination voltage is a voltage of smaller magnitude than the computer system voltage, a voltage between the termination voltage and the ground voltage represents a low signal level, and the termination voltage represents a high signal level.

In this embodiment, the resistive terminations pull the signal line 135 up to the termination voltage unless a bus agent is driving the signal line to the low signal level. Alternately, the computer system could be arranged such that the termination voltage supply provides a voltage representing the low signal level. This arrangement causes the termination to dissipate power when a bus agent is driving the high signal level and reduces the pull down strength required of each bus agent.

Thus, in this application, the termination voltage supply 100 provides a termination voltage signifying the high logic value which is lower than the computer voltage supply. This lower voltage reduces power consumption by the terminations and allows bus agents to more quickly drive transitions between the high and low voltage levels. Additionally, the use of a bus voltage lower than the computer system voltage allows integrated circuits which operate on a voltage lower than the computer system voltage to comply with the expected signaling levels.

To provide the appropriate termination voltage, the termination voltage supply 100 utilizes the current drive available from the computer system voltage supply yet isolates the termination voltage from fluctuations in the computer system voltage. An isolation circuit 110 couples the computer system voltage supply from an input node 125 to the output node 120. The input node 125 is coupled to receive the computer system voltage (Vcc). The output node 120 is coupled to a provide the termination voltage to the signal line terminations and to a biasing circuit 105. This biasing circuit in turn is coupled to a bias voltage node 107. The bias voltage node is coupled to a control input for the isolation circuit and is coupled to a feedback circuit 115. The biasing circuit 105 also provides a connection to the ground voltage (not shown) so that the feedback and biasing circuits can produce a bias voltage at the bias node 107 using the computer system voltage which is established relative to the ground voltage.

In essence, the purpose of the isolation circuit is to provide a voltage at the output node 120 which is primarily dependent on the voltage at the voltage bias node 107 rather than the computer system voltage provided on the input node 125. Tolerable variations (e.g. ten percent) in the computer system voltage translate to variations which become intolerable if directly reflected in the termination voltage. Any device which provides a known voltage drop from a control terminal while drawing current from another (albeit higher) voltage supply could provide the necessary isolation. For example, one or more bipolar transistors may be used to provide a suitable voltage relationship.

The biasing circuit 105 processes the output voltage and cooperates with the feedback circuit 115 to provide the appropriate voltage on the bias node 107. A variety of feedback and bias circuits could be used provided that they cooperate to generate a bias voltage level at the bias node 107 allowing the isolation circuit to continue to maintain the termination voltage within an acceptable range. Such circuits may include voltage mirroring circuits, current mirrors, voltage dividers, resistors, or other conventional prior art circuits.

Figure 2:
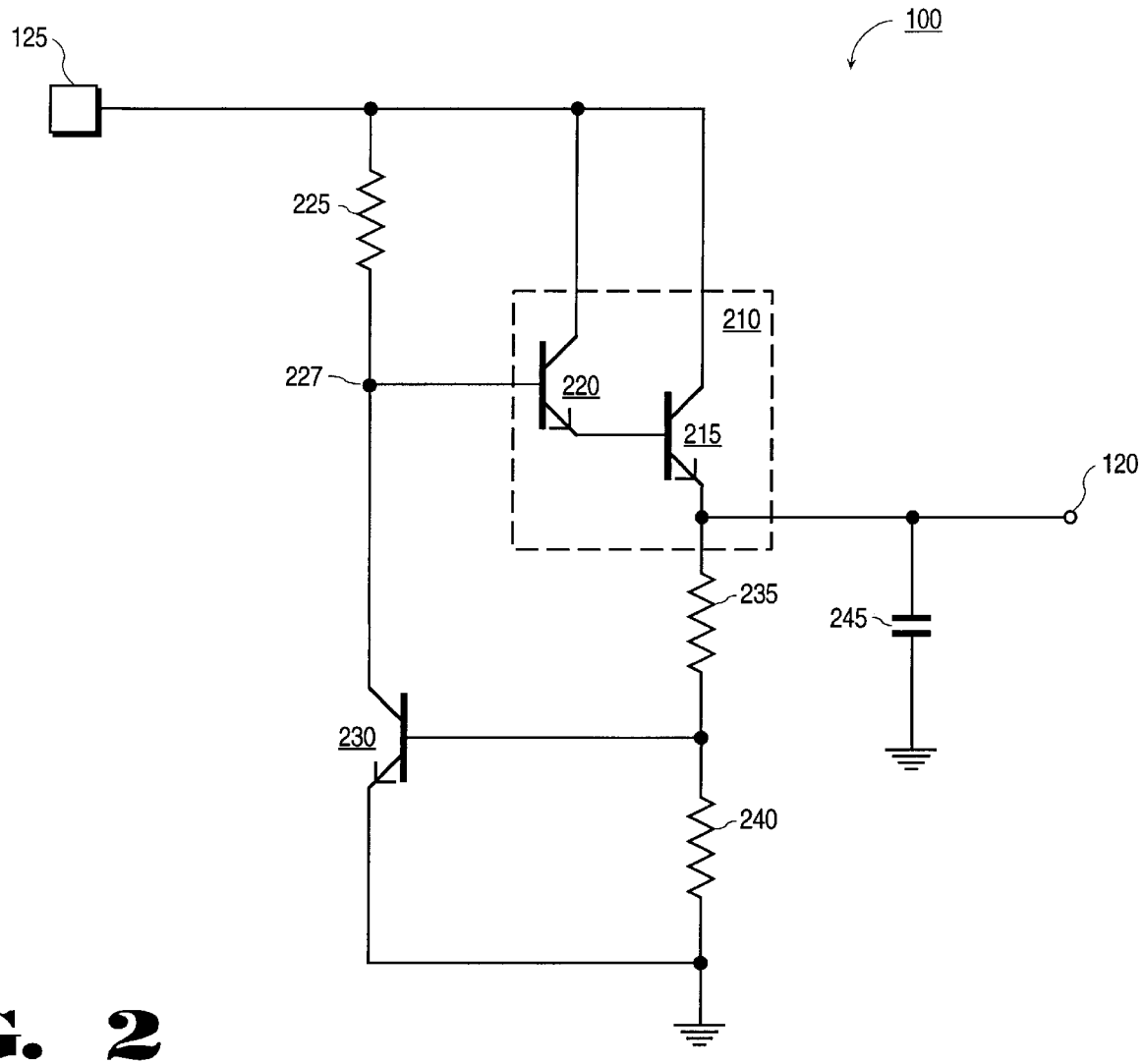
FIG. 2 is a circuit schematic of one embodiment of the bus termination voltage supply of the present invention.

FIG. 2 illustrates a particular set of devices utilized in one embodiment of the termination voltage supply 100 of the present invention. This embodiment may be used for a termination voltage supply in the system in FIG. 1, or may be used in other cases where a low cost high current voltage supply may be necessary. For example, this circuit could also provide a power supply to an integrated circuit which operates at a voltage lower than the remainder of the computer system.

In one mode, discrete components provide the lowest cost solution. Since the voltage supply relies on resistors to set bias levels, high precision (i.e. low tolerance) resistors are required. Unfortunately, the driving transistors of the voltage supply must be high power devices to terminate the bus. Since precision resistors and high power transistors are not easily fabricated on the same integrated circuit, their integration may unduly increase the cost of the voltage supply.

Thus, one preferred embodiment of the termination voltage supply of FIG. 2 employs a plurality of discrete components. In this embodiment, a transistor 230 and a voltage divider comprising a first resistor 235 and a second resistor 240 form the biasing circuit previously discussed. A resistor 225 coupled between a bias node 227 and the input node 125 forms the feedback circuit. Finally, a . Darlington pair 210 forms the isolation circuit The Darlington pair 210 forms an isolating driver circuit comprising a first transistor 215 and a second transistor 220. The first transistor has a collector coupled to the input node 125 and a base coupled the bias node 227. The second transistor has a base coupled to the emitter of the first transistor, a collector coupled to the input node 125, and an emitter coupled to the output node 120. The Darlington pair thus controllably couples the input node to the output node. In one embodiment a pair of NPN transistors is used. This arrangement of cascaded transistors, known as a Darlington pair, is commonly packaged in a single discrete component.

The current drive necessary to sustain a proper voltage at the output node 120 is provided by the voltage supply available on the input node 120. The output voltage, on the other hand, does not rely on the voltage on the input node 120. Instead, this voltage remains at approximately twice a Darlington transistor's base-to-emitter voltage drop ($V_{BE}$) below the bias node 227 as long as the darlington driver remains properly biased. The actual voltage drop from the bias node to the output node varies with operating conditions as well as between different transistors and/or darlington pairs.

Careful selection of values for the voltage divider resistors (respectively $R_{235}$ and $R_{240}$ for resistors 235 and 240) ensures proper biasing of the Darlington pair 210. The transistor 230, by way of its fixed $V_{BE}$, sets the current through the resistor 240. The resistor acts as a voltage mirroring element which provides the threshold base-to-emitter voltage of transistor 230 across the resistor 240 by way of its connection the base and emitter of the transistor 230. Provided that the resistor 235 is not too large in value, the voltage at the output node is roughly $V_{BE}^* (R_{235}+R_{240})/R_{240}$.

Of course, this arrangement does not produce a voltage greater than that received on the input node 125. If the resistor 235 is too large, insufficient current will flow through the voltage divider and the Darlington pair to keep the transistor 230 enabled. In this case, the darlington pair cannot maintain the output node 120 at the value calculated using the above equation.

Feedback is also important in maintaining the proper voltage at the output node 120. The resistor 225 provides feedback by reflecting output voltage fluctuations at the base of the transistor 220 of the Darlington pair. When the load on the output node 120 increases, causing the output voltage to dip, the voltage at the base of transistor 230 also necessarily dips. This results in a smaller base current to the transistor 230 and consequently a smaller current flow from collector to emitter. The smaller current flow through the transistor 230 reduces the voltage drop across the resistor 225 thereby raising the voltage on the bias node 227. This, in turn, increases the base current to the transistor 220 and allows more current to flow through the Darlington pair 210 to sustain the sagging output voltage.

Due to this feedback loop, the voltage supply is responsive to a changing load at the output node. Such responsiveness is particularly important when trying to maintain a termination voltage for a rapidly switching bus in computer system. Thus, the voltage supply's minimal componentry benefits not only the voltage supply cost but also the voltage supply responsiveness.

With this understanding of the operation of the voltage supply, a more accurate approximation of the output voltage may be derived. Using $V_{BE1}$ as the threshold base-to-emitter voltage and $\beta_1$ as the gain of the transistor 230, $V_{BE2}$ as the threshold voltage and $\beta_2$ as the gain of the Darlington pair 210, and T as the temperature in centigrade, the following equations characterize the voltage supply.

The output voltage is approximately:

$$\frac{\left(\frac{Vcc\cdot\beta_2}{R_{225}}-\frac{2\cdot V_{BE2}\cdot\beta_2}{R_{225}}+V_{BE1}\cdot\beta_1\cdot\beta_2\cdot\left(\frac{1}{R_{235}}+\frac{1}{R_{240}}\right)+\frac{V_{BE1}}{R_{225}}-I_{out}\right)}{\left(\frac{\beta_2}{R_{225}}+\frac{\beta_1\cdot\beta_2}{R_{235}}-\frac{1}{R_{235}}\right)}$$

The resulting output impedance of the voltage supply is approximately:

$$\frac{R_{225}}{\beta_1\beta_2}$$

The temperature affects the final output voltage through the transistor
threshold voltages. $V_{BE1}$ is the threshold drop which forms the dominant temperature dependent component of the output voltage. In contrast, the typical diode based solution exhibits a much greater threshold voltage dependency because the temperature based fluctuation of a single diode is multiplied by the number of diodes connected in series to achieve the appropriate output voltage.

In choosing component values, desired output voltage, power consumption, and response time should be taken into account. As previously discussed, the resistors 235 and 240 determine the appropriate output voltage value and should not be so large as to cut off the Darlington pair. The resistor 225 should also not be so large as to cut off the Darlington pair; however, all of these resistors waste power if too small of values are chosen.

In one embodiment, the voltage supply is used in a computer system and generates up to two amperes of current at a target of a 1.5 volts from a 3.3 volt computer system supply. These voltages are of course target or approximate voltages and the actual values may vary as much as ten percent during normal operation. In this embodiment, the Darlington pair 210 is a MJD112 Complementary Darlington Power Transistor and the transistor 230 is a MMBT2222LT1 transistor, both of which are available from Motorola Corp. of Schaumburg Ill. In one embodiment, the resistors 235 and 240 are respectively 43 and 27 ohms; however, commercial availability dictates the use of 39 and 24 ohm resistors in another embodiment.

All of these components are discrete components which may be surface mounted on a printed circuit board to provide an inexpensive voltage supply. This voltage supply exhibits power supply noise rejection capabilities by way of its isolation mechanism and also provides better thermal properties than a diode based solution.

Thus, the present invention provides a voltage supply which may be used for bus termination. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A termination voltage supply comprising:

a voltage isolation circuit including a transistor driver element coupling an input voltage supply node to provide an output voltage on an output node, said transistor driver element having a transistor driver element control input;

a resistive termination device coupled to the output node and to a bus signal line to provide a termination voltage to a plurality of bus agents coupled to drive the bus signal line;

a biasing circuit comprising:

a voltage divider having a first voltage divider element coupling said output node to a voltage divider node, said voltage divider also having a second voltage divider element coupling the voltage divider node to a second voltage supply node;

a bias transistor which has a control input coupled to said voltage divider node and which couples said transistor driver element control input to said second voltage supply node; and an element coupled to said bias transistor which, in conjunction with said bias transistor and said voltage divider, reflects voltage fluctuations in said output voltage at said transistor driver element control input said voltage fluctuations in said output voltage being caused by the plurality of bus agents switching the bus signal line.

2. The termination voltage supply of claim 1 wherein the first voltage divider element is a first resistor and the second voltage divider element is a second resistor.

3. The termination voltage supply of claim 1 wherein said element comprises a bias resistor which couples said input voltage supply node to said transistor driver element control input.

4. The termination voltage supply of claim 1 wherein said transistor driver element is a Darlington transistor pair.

5. The termination voltage supply of claim 3 wherein the transistor driver element comprises:

a first driver transistor which has a first driver transistor base which forms said transistor driver element control input, a first driver transistor collector coupled to said input voltage supply node, and a first driver transistor emitter; and a second driver transistor which has a second driver transistor base coupled to said first driver transistor emitter, a second driver transistor collector coupled to said input voltage supply node, and an emitter coupled to said output node.

6. The termination voltage supply of claim 5 wherein said first driver transistor and said second driver transistor are NPN transistors.

7. The termination voltage supply of claim 1 wherein said input voltage supply node provides a voltage of approximately 3.3 volts, said second voltage supply node provides approximately 0 volts, and said termination voltage supply provides said output voltage of approximately 1.5 volts on said output node.

8. The termination voltage supply of claim 2 wherein said output voltage provided on said output node is a function of a base to emitter voltage of said bias transistor and a ratio of a sum of a first resistance of the first resistor and a second resistance of said second resistor to said second resistance.

9. The termination voltage supply of claim 2 wherein said first resistor, said second resistor, said transistor driver element, and said bias transistor are discrete components.

10. The termination voltage supply of claim 5 wherein the first driver transistor has a first gain and the second driver transistor has a second gain, and wherein the termination voltage supply provides an output impedance approximated by a bias resistance of the bias resistor divided by a product of the first gain and the second gain.

11. The termination voltage supply of claim 2 wherein said first resistor has a first value of approximately 39 ohms, and said second resistor has a second value of approximately 24 ohms.

12. A system which provides a first voltage on a first voltage supply node, comprising:

a plurality of bus agents coupled to a bus to drive a signal line;

a driver which has a driver control input and which couples said first voltage supply node to an output node, the driver providing at the output node a termination voltage for a changing load;

a first resistive element which couples said output node to a bias voltage node;

a second resistive element which couples said bias voltage node to a second voltage supply node;

a bias element which couples said first voltage supply node to said driver control input;

a bias transistor which has a control input coupled to said bias voltage node and which cooperates with the first resistive element, the second resistive element, and the bias element to compensate for voltage fluctuations in said output voltage caused by changes in the changing load at the output node couples said driver control input to said second voltage supply node; and a resistive termination coupling said termination voltage on said output node to said signal line.

13. The system of claim 12 wherein said bias element comprises a bias resistor.

14. The system of claim 13 wherein the driver comprises:

a first driver transistor which has a first driver transistor base forming said driver control input, a first driver transistor collector coupled to said first voltage supply node, and a first driver transistor emitter; and s a second driver transistor which has a second driver transistor base coupled to said first driver transistor emitter, a second driver collector coupled to said first voltage supply node, and a second driver transistor emitter coupled to said output node.

15. The system of claim 12 wherein an output voltage provided on said output node is a function of a base to emitter voltage of said bias transistor and a ratio of a sum of a resistance of the voltage mirroring element and a resistance of the first resistive element to a resistance of the second resistive element.

16. The system of claim 12 wherein said first resistive element, said voltage mirroring element, said driver, and said bias transistor are discrete components.

17. The system of claim 14 wherein the first driver transistor has a first gain and the second driver transistor has a second gain, and wherein the driver provides an output impedance approximated by a bias resistance of the bias resistor divided by a product of the first gain and the second gain.

18. A system which provides a first voltage from a first voltage supply, comprising:

a plurality of bus agents coupled to a bus to drive a signal line;

isolation means for isolating an output voltage from fluctuations in the first voltage while supplying current from said first voltage supply to maintain said output voltage on an output node;

biasing means coupled to said output node and coupled to a second voltage supply, said biasing means providing a bias voltage to a control input of said isolation means;

feedback means coupled to said biasing means and coupled to said first voltage supply, said feedback means cooperating with said biasing means to maintain said output voltage by adjusting said bias voltage provided to said control input of said isolation means to compensate for voltage fluctuations in said output voltage caused by the plurality of bus agents switching the signal line; and resistive means resistively coupling said output node to said signal line.

19. The system of claim 18 wherein said biasing means comprises:

first resistive means coupled to said output node;

second resistive means which couples said first resistive means to said second voltage supply; and fixed voltage reference means coupled to said first resistive means and said second resistive means and coupled to said second voltage supply, said fixed voltage reference means providing a fixed reference voltage across said second resistive means.

20. The system of claim 19 wherein a transistor threshold voltage provides a fixed voltage for said fixed voltage reference means.

21. A system comprising:

a plurality of bus agents coupled to drive a signal line;

a first resistive element having a first resistive element first terminal coupled to a system voltage supply;

a Darlington pair having a Darlington pair collector input coupled to the system voltage supply, a Darlington pair base terminal to a second terminal of the first resistive element, and a Darlington pair emitter terminal connected to supply a termination voltage to the signal line;

a voltage divider having a first divider resistor and a second divider resistor coupled in series between the Darlington pair emitter terminal and a ground terminal, the voltage divider having a voltage divider node between the first and second divider resistors; and an NPN transistor having a transistor base terminal coupled to the voltage divider node, a transistor collector coupled to a second terminal of the first resistive element, and an emitter coupled to the ground terminal.

* * * * *

UNITED STATES PATENT AND TRADEMARK OFFICE

CERTIFICATE OF CORRECTION

PATENT NO. : 5,856,755
DATED : January 5, 1999
INVENTOR(S) : Falconer et al.

It is certified that error appears in the above-identified patent and that said Letters Patent is hereby corrected as shown below:

Column 4,
Line 44, after "a", delete ".".
Line 45, after "circuit", insert -- . --.

Column 8,
Line 26, delete "s".

Signed and Sealed this

Seventeenth Day of June, 2003

JAMES E. ROGAN
*Director of the United States Patent and Trademark Office*